US010464638B2

(12) United States Patent
Retallick

(10) Patent No.: US 10,464,638 B2
(45) Date of Patent: Nov. 5, 2019

(54) RETALLICK BOOM TENT

(71) Applicant: R. Garth Retallick, Port Orchard, WA (US)

(72) Inventor: R. Garth Retallick, Port Orchard, WA (US)

( * ) Notice: Subject to any disclaimer, the term of this patent is extended or adjusted under 35 U.S.C. 154(b) by 8 days.

(21) Appl. No.: 15/362,043

(22) Filed: Nov. 28, 2016

(65) Prior Publication Data

US 2018/0148134 A1 May 31, 2018

(51) Int. Cl.
*B63B 17/02* (2006.01)

(52) U.S. Cl.
CPC ..... *B63B 17/02* (2013.01)

(58) Field of Classification Search
CPC ..... B63B 19/00; B63B 17/02; B63B 17/023; E04H 9/14; E04H 15/06; E04H 15/58; E04H 125/64
See application file for complete search history.

(56) References Cited

U.S. PATENT DOCUMENTS 2,849,010 A * 8/1958 Marino ..... B63B 19/12 135/115
3,238,954 A * 3/1966 Eriksson ..... B63B 17/023 135/119
D224,985 S * 10/1972 Kostanecki ..... D12/303
4,492,175 A * 1/1985 Johnson ..... B63B 17/02 114/361
4,745,871 A * 5/1988 Wieder ..... B63H 9/1092 114/102.15
4,917,035 A * 4/1990 Thomson ..... B63B 35/73 114/138
5,027,739 A * 7/1991 Lackovic ..... B63B 17/023 114/361
9,440,709 B1 * 9/2016 Perrone ..... B63B 17/02
2003/0010273 A1 * 1/2003 Treytiak ..... B63B 17/02 114/361
2009/0293797 A1 * 12/2009 Kent ..... B63B 17/02 114/361
2014/0299035 A1 * 10/2014 Schiarini ..... B63B 17/02 114/361
2016/0311503 A1 * 10/2016 Duplain ..... B63B 17/02

* cited by examiner

*Primary Examiner* — Christopher R Harmon
(74) *Attorney, Agent, or Firm* — Brian R. Galvin; Galvin Patent Law, LLC

(57) ABSTRACT

A boom tent system for use on sailboats, comprising a tarpaulin tent extending from mast to the end of the boom, secured via an adjustable latch and hook system, and providing additional individual flaps secured by male and female common-sense twist fasteners, with zippered doors allowing boaters to enter or exit without the need to dismantle any part of the system.

1 Claim, 7 Drawing Sheets

RETALLICK BOOM TENT

CROSS-REFERENCE TO RELATED APPLICATIONS

None.

BACKGROUND

Field of the Art

The disclosure relates to the field of sailing, and more particularly to the field of protective covers for sailboats.

Discussion of the State of the Art

Most sailboat owners use tarps and various bungee cords or ropes and weights to keep their sailboats protected from the rain and elements. However, the ropes break after a season due to exposure and stress, or the bungee cords get stretched and sunlight breaks down the material. Another disadvantage is the need take most of it off to get on the boat if there is a problem, or if one happens to live on the boat. The tarp design, while inexpensive, is not the most effective and as a result is not inexpensive in the long run as one needs to replace the tarp, lines, and weights because of wear, tear, and the elements.

The present invention addresses the drawbacks of using a tarp as a protective cover for sailboats.

SUMMARY

Accordingly, the inventor has conceived and reduced to practice, a boom tent covering for sailboats. The boom tent is a covering, specifically for sailboats, which allows easy access to the boat, which is suitable for the daily comings and goings of a live-aboard boater or someone requiring daily access to the boat; and a secured mounting without regard to placement of anchoring points on or around the deck of the boat. The tent also provides secure protection by balancing tautness and flexibility with durability for a wind conscious profile.

According to a preferred embodiment, a boom tent system for use on sailboats is disclosed, comprising: a tent tarp configured to be positioned over a boom of a sailboat and secured to portions of the sailboat with a plurality of securing elements; wherein the tent tarp comprises port and starboard zippered flaps and a plurality of spaced-apart grommets and weight pouches located along each port and starboard lower side edge of the tent tarp; wherein the securing elements comprise hooks positioned between grommets for secured anchoring to the sailboat, bungee cords each housed in a flap of the tent tarp for providing adjustable tension of the tent tarp through the grommets, and barrel latches on either side of the hooks for securing against either the hooks or the grommets to allow variable lengths and tensions of the bungee cords and securing in different points along a bungee cord.

BRIEF DESCRIPTION OF THE DRAWING FIGURES

DETAILED DESCRIPTION

The inventor has conceived, and reduced to practice, a boom tent covering for sailboats. The boom tent is a covering, specifically for sailboats, which allows easy access to the boat, which is suitable for the daily comings and goings of a live-aboard boater or someone requiring daily access to the boat; and a secured mounting without regard to placement of anchoring points on or around the deck of the boat. The tent also provides secure protection by balancing tautness and flexibility with durability for a wind conscious profile.

The tent is composed of four panels of fabric (tarpaulin) in a rectangular shape with anchoring lines built directly into the tent, and with a latch and hook system for adjustments to provide security in adverse weather conditions. The latch and hook system are composed of a bungee cord and hooks with barrel fasteners on either side to secure the bungee to various point of the deck. The tent is also composed of a series of flaps that extend from the forward edge of the tarpaulin; these flaps are secured with common-sense twist fasteners and allow the stays to go through the tarpaulin.

Experimentation on different designs indicated that tension is more important and better achieved when the ropes draw the fabric at a downward angle, though the common thought was to draw them forward and aft, as well as straight down. Also, discovered was that if the fabric was too taught it would not hold up to stiff wind; too loose, and the grommets would tear out and the ropes/bungees would fail early due to wear.

First, the bungees are built into the tarp, which removes me need to constantly have to find ropes and bungees of the right size. Second, the bungees are placed under the fabric so as to prevent sun damage and exposure to the elements. Third, having zippered flaps on both the port (left facing the bow or front of the boat) and starboard (right facing the bow) sides allows for easy access on and off the boat, which also prevents having to readjust the tarp. Forth, weight pockets at the bottom of the tarp prevent the need to attach weights to the lower grommets, which further stresses the fabric, and results in things bouncing against the side of the hull. Additionally, one can adjust the amount of weight and further allow for a custom fit. By securing the weight bag into the pockets with velcro and including draw strings secured at points along the tent with which one can raise and drop the sides to either protect against weather or allow light in during better weather.

The tent is a covering for sailboats which allows easy access to the boat and a secured mounting without regard to placement of anchoring points on or around the deck of the boat. The structure is composed of four panels of fabric with anchoring lines are built into the tent and adjustable with a hook and latch system which allows adjustment to ensure the optimal security so the tent remains secure in adverse weather conditions.

Figure 1:
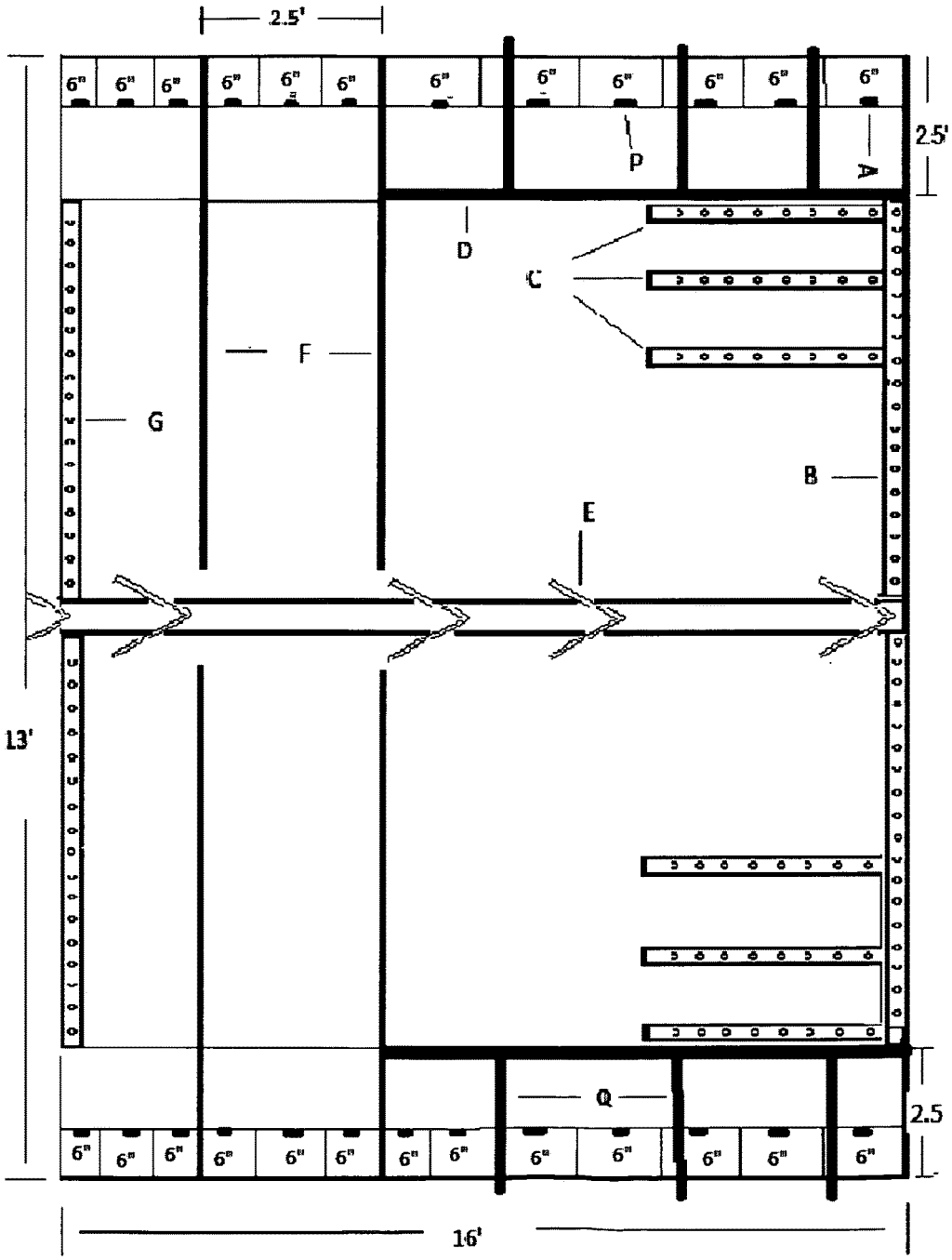
FIG. 1 is a view looking up from the bottom of the tent; from forward (front or bow of the boat) to aft (back of the boat).
Figure 2:
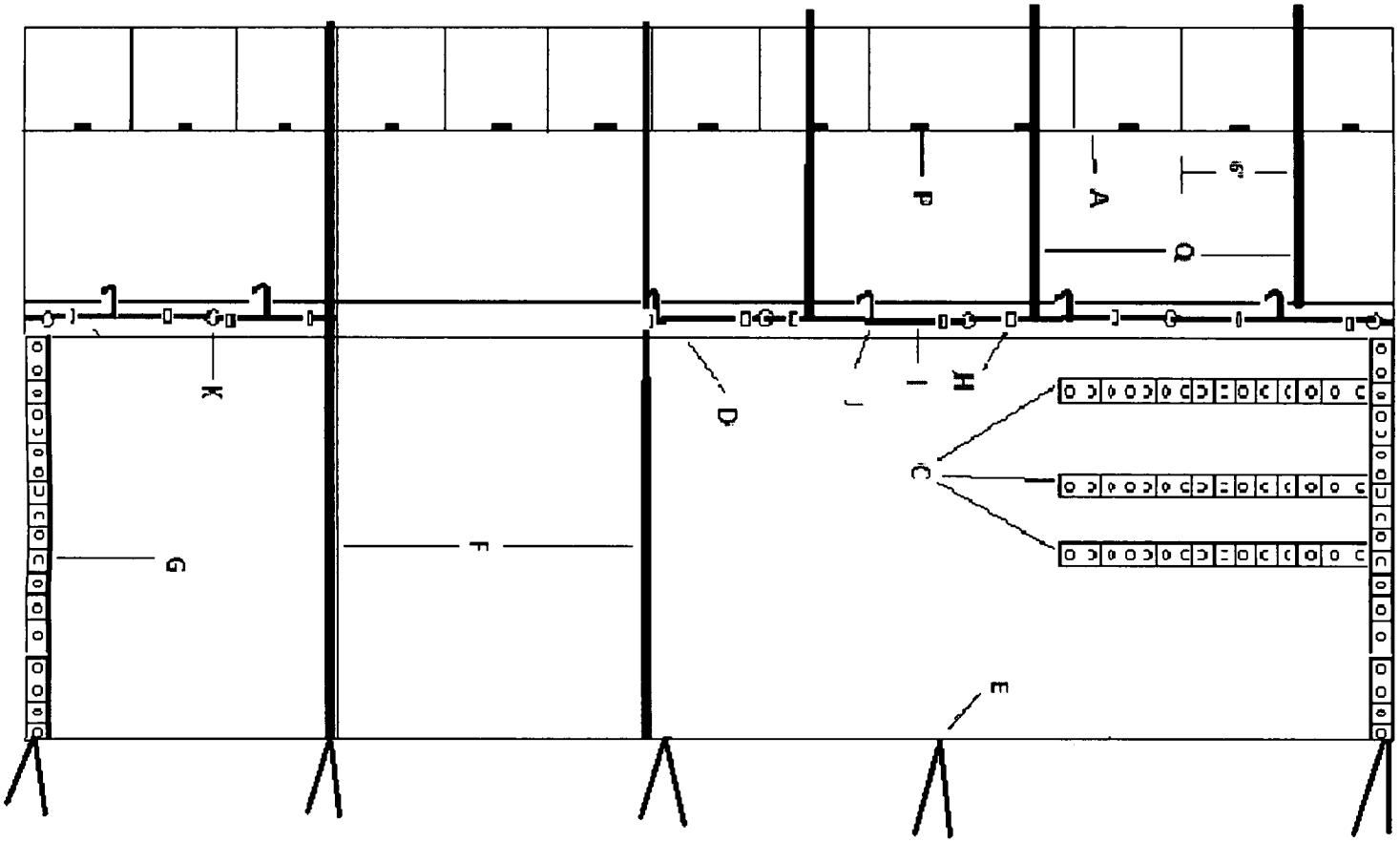
FIG. 2 is a view looking from inside the boat at the starboard side (right side facing the bow or front of the boat).
Figure 4:
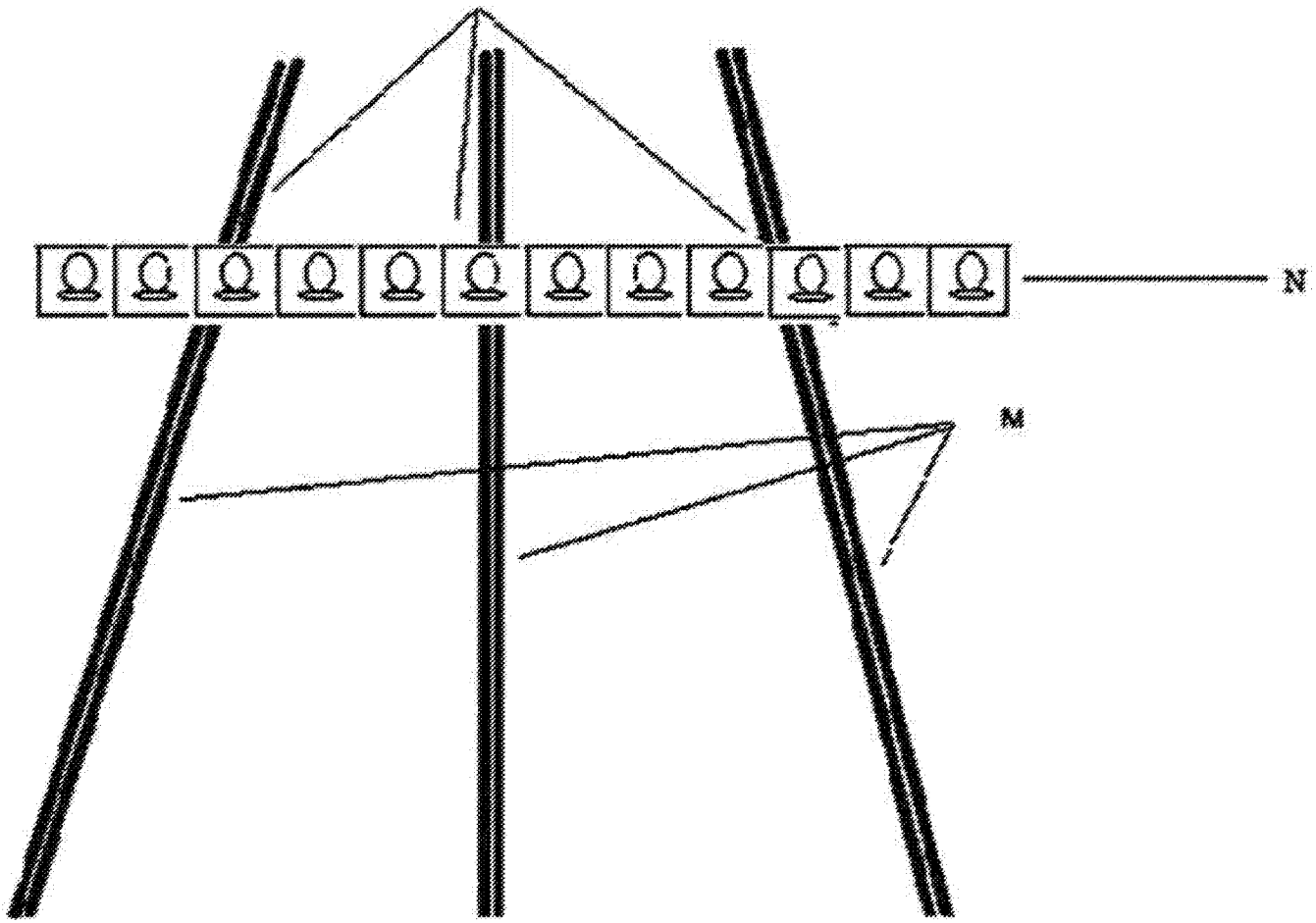
FIG. 4 is a detailed view of the stay-latch system.
Figure 5:
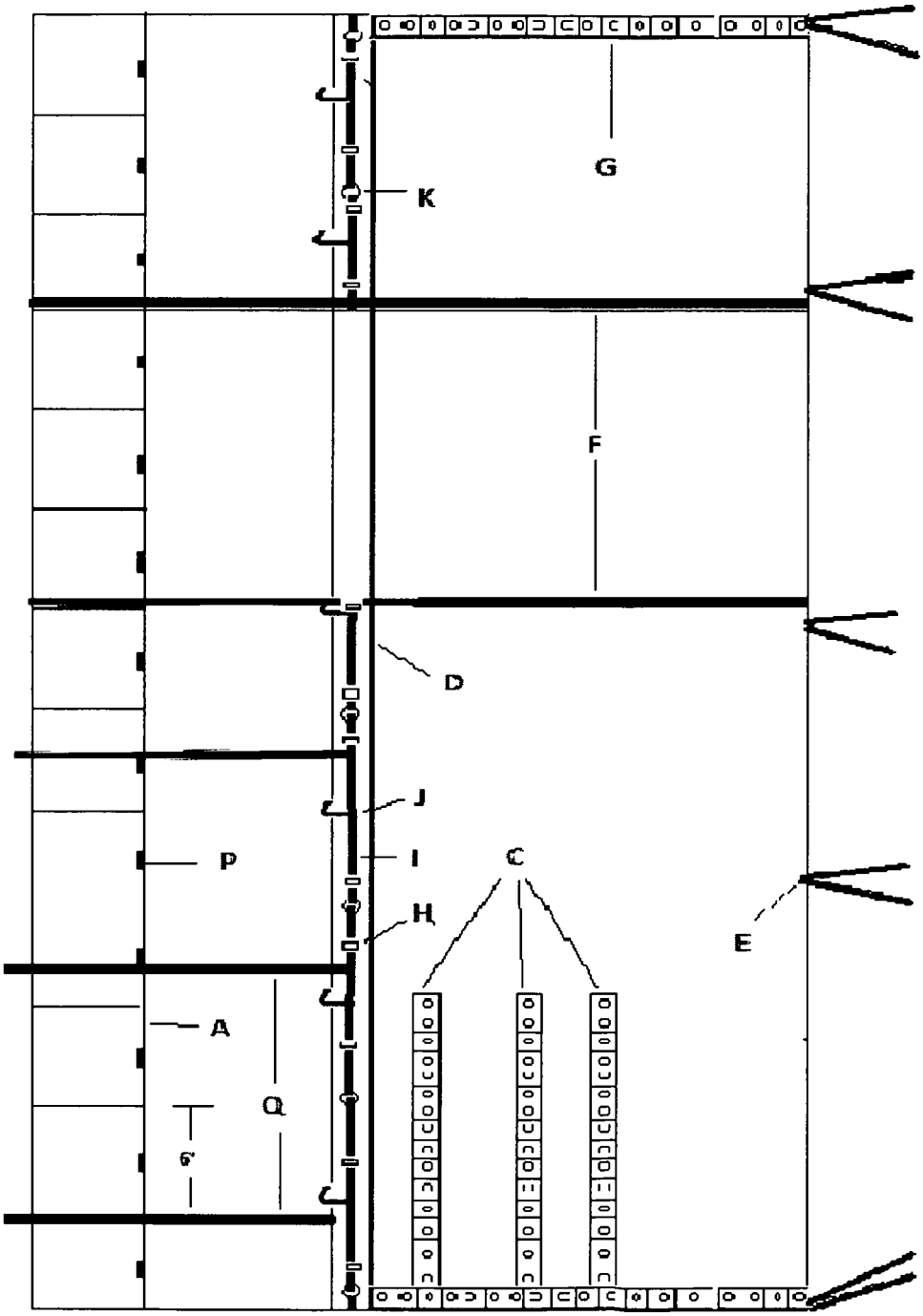
FIG. 5 is an inside view of port (right side of boat facing the bow or front).

The tent is secured to the mast and boom by simple boom ties which are constructed of the fabric double over and sewn into 2.5 foot lengths and can be seen in FIGS. 1, 2, and 5, item E. Dropping away from the mast one sees flaps with common sense twist fasteners as seen in FIGS. 1, 2, and 5, item C, with a in-depth view in FIG. 4 which shows the construction and function if each flap as item N, with the open flaps as item 0. Each section is made of 2 layers of fabric with a series of 2"×2" flaps cut into each. Each flap has a common sense twist fasteners in the middle. These allow for the mast stays (cables which assist in keeping the mast stationary and vertical FIG. 4, item M) to go through the boom tent. The flap in which the stay goes through is not secured as seen in FIG. 4, item 0, however all other flaps are secured. This provides durability and strength against strong winds.

Figure 3:
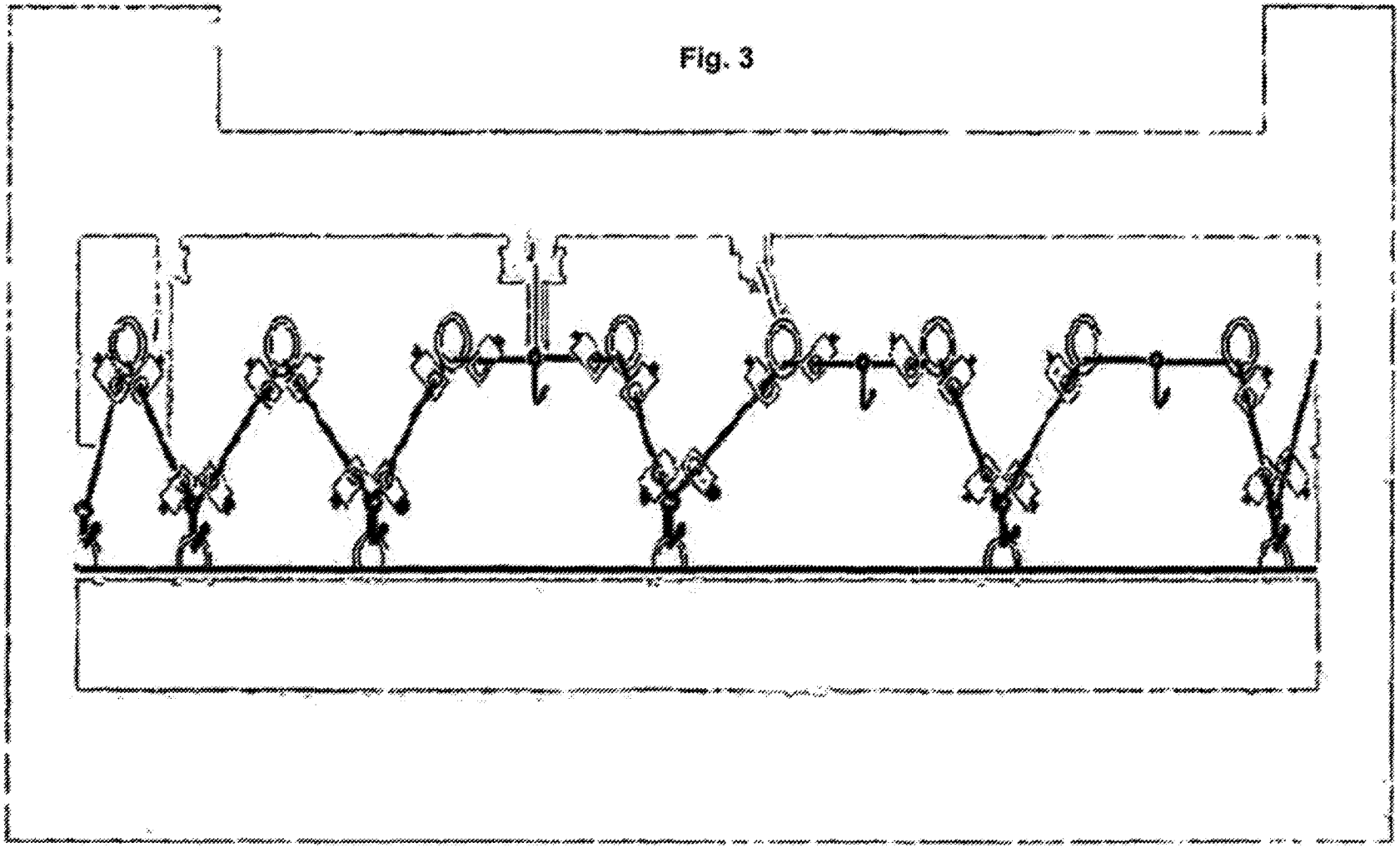
FIG. 3 is a detailed view of the latch, hook, and grommet system.

The tent is secured by a doubled over flap of fabric designed to provide additional strength and is shown in FIGS. 1, 2, and 5, item D. This flap houses a bungee cord, seen in more detail in FIG. 3, item I, which fits through a series of grommets set approximately 12 inches apart. As seen in FIG. 3, between the grommets are hooks (Item J) which secure to naturally occurring anchor points (Item L) on the boat such as mast stays, security line stanchions, and miscellaneous line anchors. On either side of the hooks are barrel latches (Items H) which can be secured against either the hooks or the grommets to allow variable lengths and tensions of the bungee cords and securing in different points along the bungee cord. This will allow the tension of the tarp to be adjustable and therefore sustain severe winds and weather conditions.

The back quarter of the tent, seen in FIGS. 1, 2, 5, and 6, item F, has two, 2.5 foot flaps that go from the bottom of the fabric to 8 inches from center, one port and one starboard with 110 nylon zippers on either side and come within 1 foot of each other in the center of the tent. The nylon zippers withstand the corrosive effects of both UV and salt air and allow entry to the main hatch and cockpit area of the boat without having to remove the tent or any portion thereof.

To assist in keeping the tent secured during inclement weather there are pouches 6 inches in length and 4 inches in depth which can hold ¼ pound bags of sand and keep the edges of the tent from flapping in heavy winds. (FIGS. 1, 2, 5, and 6, Item A). To secure the bags of sand each pouch has a piece of 1 inch square Velcro in the middle, item P as shown on FIGS. 1, 2, and 5.

In addition to the above name materials and components one can see along the forward (front) and aft (rear) sections of the tent (FIGS. 1, 2, 5, and 6, items B and G) Male and female common sense twist fasteners. Item B, the male end of the Common sense twist fasteners secured on a 2" doubled hem seam. This is for the addition of a forward piece which will overlap the main tent from the top, thus creating a channel for the water to run down and away from the open seam. Item G, aft end female common sense twist fastener ends. The female ends of the commonsense twist fasteners are placed along the aft reinforced end of the tent every 2". This provides a secure point to attach a covering for the stern of the boat (which design shall be furnished at a future date) and allows for water to flow aft. Since most boats are moored over the winter bow into the wind, the wind will drive the rain aft helping to shed the water away from the seam and provide a shear to prevent the wind from catching the seam where the two pieces meet and putting stress on the fabric and twist fasteners.

Figure 6:
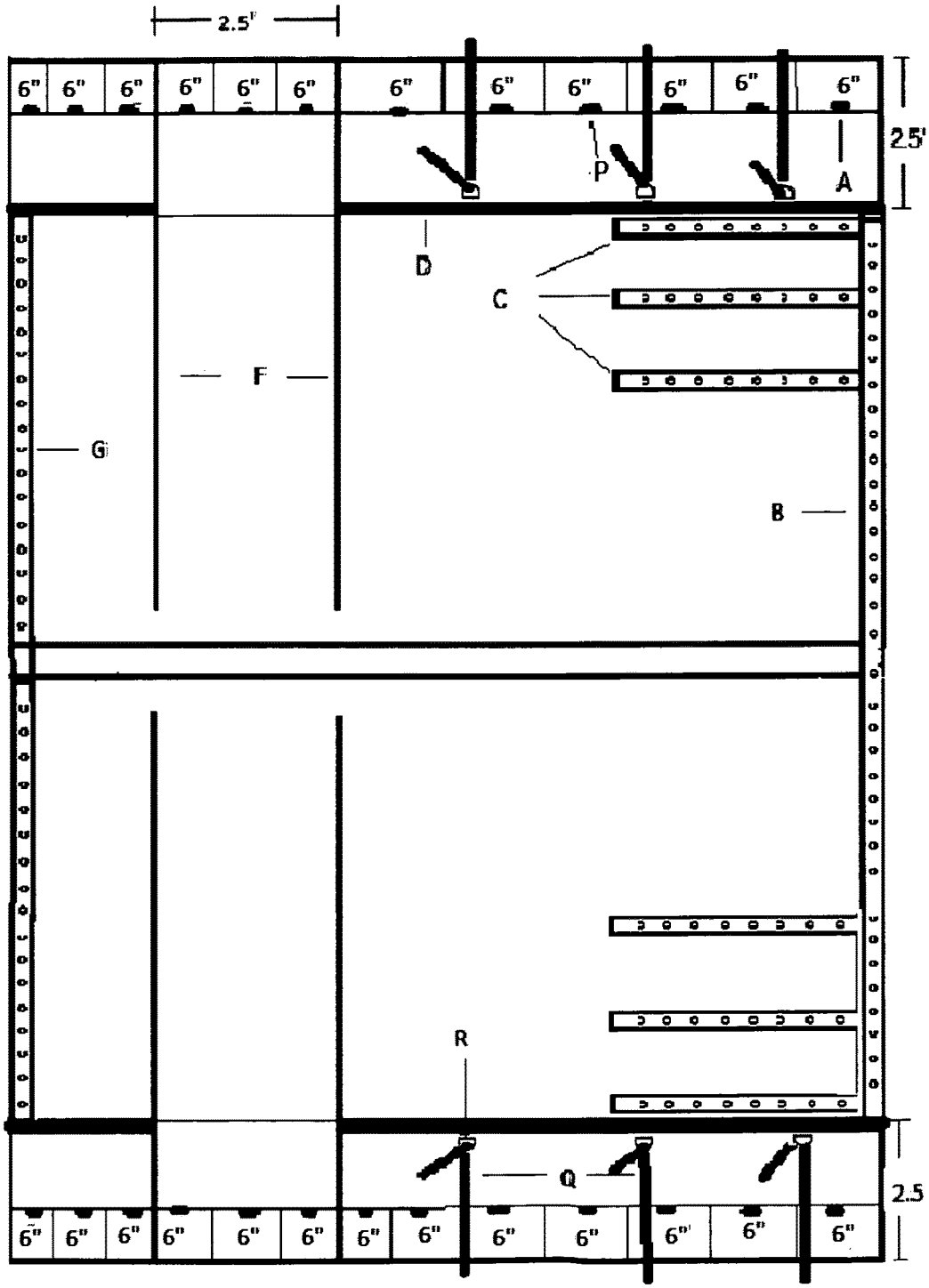
FIG. 6 is a top view of the tent.
Figure 7:
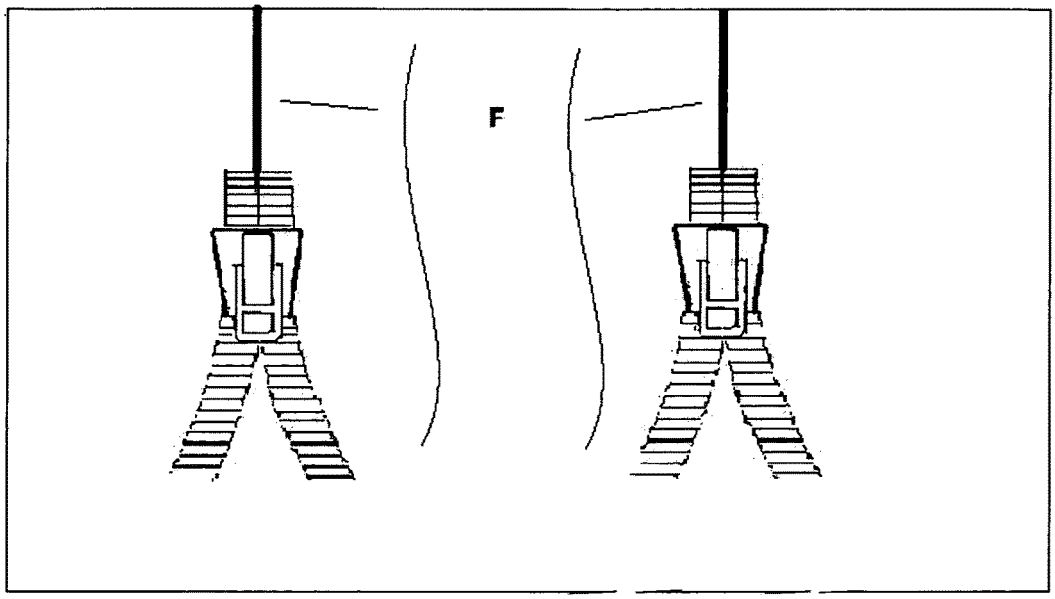

In addition to the above named items each tent has a 5.5 foot draw as seen in FIGS. 1, 2, 5, and 6 (Item Q) string made of the same material as the mast and boom ties which are sewn to the fabric just above the flap identified as Item D and leads to the outside and secures into a double D ring as seen in FIG. 6 Item R, so as to be able to draw the flaps up and allow sunlight into the main cabin.

Whereas all of the concepts and material have previously been used, the combination of these materials in conjunction with the creative use of the flap and common sense twist fastener to allow securing around the stays has not been readily done before. However, add the barrel latch, grommet and hook system, which has never been accomplished before, make this tent system totally unique in that all of the components needed to use one tent design for a variety of different sail boats is included in one package. Unroll the tent, hook and latch where it needs to be. The simplicity of this device plus the hook and latch system make it easily set up in inclement weather.

DETAILED DESCRIPTION OF EXEMPLARY EMBODIMENTS AND ASPECTS

FIG. 1 is a view looking up from the bottom of the tent; from forward (front or bow of the boat) to aft (back of the boat), showing:

Item A. Weight pockets where variable amounts of weights, usually plastic bags filled with ¼ pound of sand, are place to help secure the bottom edges of the tent down. The pockets are double stitched to add additional support.

Item B. Forward end Male Common Sense twist fastener ends. The male end of the commonsense twist fasteners are place along the forward reinforced end of the tent every 2". This provides for a secure point to attach a covering for the bow of the boat (which design shall be furnished at a future date) and allows for water to flow aft. Since most boats are moored over the winter bow into the wind, the wind will drive the rain aft helping to shed the water away from the seam and provide a shear to prevent the wind from catching the seam where the two pieces meet and putting stress on the fabric and twist fasteners.

Item C. Flap with common sense twist fasteners for stays. Stays are the cables which fasten from the main deck of the boat and go the height of the mast. These are used to stabilize the mast and keep it from leaning too far one way or the other when the sail is up. The flap is made of 2" squares of reinforced fabric cut on 3 sides with Common sense twist fasteners positioned in the center of the squares. These are designed to allow the stays to go through the tent in such a way as the flap in which the stay goes through can remain unlatched while the others stay secured. This will allow for protection of the deck from the elements, stability of the mast, and the ability to accomplish both while maintaining the tinsel strength of the tent to withstand high winds and driving rains. Additional detail can be seen in FIG. 4

Item D. The seam area where the barrel Latch, hook and Grommet system is. This will be seen in more detail in FIG. 3

Item E. Boom ties add another place with which to secure the tent. Ties occur at specific points and are a minimum of 2' long each, depending on the size of ones sail or if one is going to have the tent up while a sail on the boom.

Item F. 2.5 foot flaps that go from the bottom of the fabric to 12 inches from center, one port and one starboard with 110 nylon zippers. The nylon zippers withstand the corrosive effects of both UV and salt air and allow entry to the main hatch and cockpit area of the boat without having to remove the tent or any portion thereof.

Item G. Aft end female common sense twist fastener ends. The female ends of the commonsense twist fasteners are placed along the aft reinforced end of the tent every 2". This provides a secure point to attach a covering for the stern of the boat (which design shall be furnished at a future date)

and allows for water to flow aft. Since most boats are moored over the winter bow into the wind, the wind will drive the rain aft helping to shed the water away from the seam and provide a shear to prevent the wind from catching the seam where the two pieces meet and putting stress on the fabric and twist fasteners.

Item H, Barrel Latch. A barrel latch is a pre-made apparatus which is a tube with 2 holes in it, one in the top and one going through the unit at the side. A spring is inside attached to a post which extends through the top of the unit. The post has a hole in the side that matches the hole in the unit. The bungee cord feed through the hole in the side of the unit when the post is pushed down from the top of the unit. When pressure is released the spring pushes the tube up and closes off the holes so the bungee will remain in a fixed location.

Item P. 5.5 foot Draw Strings constructed of folded canvas and used to draw the sides of the tent up so as to allow sunlight into the boat.

Item Q 5.5 foot Draw Strings constructed of folded canvas and used to draw the sides of the tent up so as to allow sunlight into the boat.

FIG. 2 is a view looking from inside the boat at the starboard side (right side facing the bow or front of the boat), showing:

Item A. Weight pockets where variable amounts of weights, usually plastic bags filled with ¼ pound of sand, are place to help secure the bottom edges of the tent down. The pockets are double stitched to add additional support.

Item B. Forward end Male Common Sense twist fastener ends. The male end of the commonsense twist fasteners are place along the forward reinforced end of the tent every 2". This provides for a secure point to attach a covering for the bow of the boat (which design shall be furnished at a future date) and allows for water to flow aft. Since most boats are moored over the winter bow into the wind, the wind will drive the rain aft helping to shed the water away from the seam and provide a shear to prevent the wind from catching the seam where the two pieces meet and putting stress on the fabric and twist fasteners.

Item C. Flap with common sense twist fasteners for stays. Stays are the cables which fasten from the main deck of the boat and go the height of the mast. These are used to stabilize the mast and keep it from leaning too far one way or the other when the sail is up. The flap is made of 2" squares of reinforced fabric cut on 3 sides with Common sense twist fasteners positioned in the center of the squares. These are designed to allow the stays to go through the tent in such a way as the flap in which the stay goes through can remain unlatched while the others stay secured. This will allow for protection of the deck from the elements, stability of the mast, and the ability to accomplish both while maintaining the tinsel strength of the tent to withstand high winds and driving rains. Additional detail can be seen in Item D. The seam area where the barrel Latch, hook and Grommet system is. This will be seen in more detail in FIG. 3

Item E. Boom ties add another place with which to secure the tent. Ties occur at specific points and are a minimum of 2' long each, depending on the size of ones sail or if one is going to have the tent up while a sail on the boom.

Item F. 2.5 foot flaps that go from the bottom of the fabric to 12 inches from center, one port and one starboard with 110 nylon zippers. The nylon zippers withstand the corrosive effects of both UV and salt air and allow entry to the main hatch and cockpit area of the boat without having to remove the tent or any portion thereof.

Item G. Aft end female common sense twist fastener ends. The female ends of the commonsense twist fasteners are placed along the aft reinforced end of the tent every 2". This provides a secure point to attach a covering for the stern of the boat (which design shall be furnished at a future date) and allows for water to flow aft. Since most boats are moored over the winter bow into the wind, the wind will drive the rain aft helping to shed the water away from the seam and provide a shear to prevent the wind from catching the seam where the two pieces meet and putting stress on the fabric and twist fasteners.

Item H. Barrel Latch. A barrel latch is a pre-made apparatus which is a tube with 2 holes in it, one in the top and one going through the unit at the side. A spring is inside attached to a post which extends through the top of the unit. The post has a hole in the side that matches the hole in the unit. The bungee cord feed through the hole in the side of the unit when the post is pushed down from the top of the unit. When pressure is released the spring pushes the tube up and closes off the holes so the bungee will remain in a fixed location.

Item I. Bungee cord. A length of rubber/elastic cord used in camping and recreational equipment that is flexible and can be stretched to a degree and then will return to it's original position when relaxed.

Item J. Hook. Plastic/composite material with a curvature at the end used for securing objects to a point on a temporary basis Item K. Grommet. Brass reinforced hole openings that allows the bungee cord to easily move through Item P. 5.5 foot Draw Strings constructed of folded canvas and used to draw the sides of the tent up so as to allow sunlight into the boat.

Item Q. 5.5 foot Draw Strings constructed of folded canvas and used to draw the sides of the tent up so as to allow sunlight into the boat.

FIG. 3 is a detailed view of the latch, hook, and grommet system, showing:

Item H. Barrel Latch. A barrel latch is a pre-made apparatus which is a tube with 2 holes in it, one in the top and one going through the unit at the side. A spring is inside attached to a post which extends through the top of the unit. The post has a hole in the side that matches the hole in the unit. The bungee cord feed through the hole in the side of the unit when the post is pushed down from the top of the unit. When pressure is released the spring pushes the tube up and closes off the holes so the bungee will remain in a fixed location.

Item I. Bungee cord. A length of rubber/elastic cord used in camping and recreational equipment that is flexible and can be stretched to a degree and then will return to it's original position when relaxed.

Item J. Hook. Plastic/composite material with a curvature at the end used for securing objects to a point on a temporary basis Item K. Grommet. Brass reinforced hole openings that allows the bungee cord to easily move through Item L. Deck plates and various attachment points. On the deck of most ships there are pieces of equipment attached to the deck that include but are not limited to, stay posts, safety line stanchions, plates with loops for securing ropes and various pieces of equipment to the deck.

Item M. Stays. Cables, usually made of plastic or rubber coated metal wire for keeping the boom at a vertical and stable position.

FIG. 4 is a detailed view of the stay-latch system, showing:

Item M. Stays. Cables, usually made of plastic or rubber coated metal wire for keeping the boom at a vertical and stable position.

Item N. Flaps with common sense fasteners. These are pieces of the tent fabric that have been reinforced with additional fabric and cut on 3 sides so as to allow the stays to pass between. The entire strip is cut approximately 28 inches and through the forward end of the tent allowing stays mounted in various positions to go through the tent. The flaps have commonsense twist fasteners in the middle which allow for the areas where the stays go through the tent fabric to be left unsecured while the rest is secured with the twist fasteners. This allows flexibility in placement and strength in the overall area to prevent ripping during high winds, tested to 60 mph gusts.

Item O. Unsecured flaps. Areas left unsecured where the stays go through the tent.

FIG. 5 is an inside view of port (right side of boat facing the bow or front) showing:

Item A. Weight pockets where variable amounts of weights, usually plastic bags filled with ¼ pound of sand, are place to help secure the bottom edges of the tent down. The pockets are double stitched to add additional support.

Item B. Forward end Male Common Sense twist fastener ends. The male end of the commonsense twist fasteners are place along the forward reinforced end of the tent every 2". This provides for a secure point to attach a covering for the bow of the boat (which design shall be furnished at a future date) and allows for water to flow aft. Since most boats are moored over the winter bow into the wind, the wind will drive the rain aft helping to shed the water away from the seam and provide a shear to prevent the wind from catching the seam where the two pieces meet and putting stress on the fabric and twist fasteners.

Item C. Flap with common sense twist fasteners for stays. Stays are the cables which fasten from the main deck of the boat and go the height of the mast. These are used to stabilize the mast and keep it from leaning too far one way or the other when the sail is up. The flap is made of 2" squares of reinforced fabric cut on 3 sides with Common sense twist fasteners positioned in the center of the squares. These are designed to allow the stays to go through the tent in such a way as the flap in which the stay goes through can remain unlatched while the others stay secured. This will allow for protection of the deck from the elements, stability of the mast, and the ability to accomplish both while maintaining the tinsel strength of the tent to withstand high winds and driving rains. Additional detail can be seen in Item D. The seam area where the barrel Latch, hook and Grommet system is. This will be seen in more detail in FIG. 3

Item E. Boom ties add another place with which to secure the tent. Ties occur at specific points and are a minimum of 2' long each, depending on the size of ones sail or if one is going to have the tent up while a sail on the boom.

Item F. 2.5 foot flaps that go from the bottom of the fabric to 12 inches from center, one port and one starboard with 110 nylon zippers. The nylon zippers withstand the corrosive effects of both UV and salt air and allow entry to the main hatch and cockpit area of the boat without having to remove the tent or any portion thereof.

Item G. Aft end female common sense twist fastener ends. The female ends of the commonsense twist fasteners are placed along the aft reinforced end of the tent every 2". This provides a secure point to attach a covering for the stern of the boat (which design shall be furnished at a future date) and allows for water to flow aft. Since most boats are moored over the winter bow into the wind, the wind will drive the rain aft helping to shed the water away from the seam and provide a shear to prevent the wind from catching the seam where the two pieces meet and putting stress on the fabric and twist fasteners.

Item H. Barrel Latch. A barrel latch is a pre-made apparatus which is a tube with 2 holes in it, one in the top and one going through the unit at the side. A spring is inside attached to a post which extends through the top of the unit. The post has a hole in the side that matches the hole in the unit. The bungee cord feed through the hole in the side of the unit when the post is pushed down from the top of the unit. When pressure is released the spring pushes the tube up and closes off the holes so the bungee will remain in a fixed location.

Item I. Bungee cord. A length of rubber/elastic cord used in camping and recreational equipment that is flexible and can be stretched to a degree and then will return to it's original position when relaxed.

Item J. Hook. Plastic/composite material with a curvature at the end used for securing objects to a point on a temporary basis through Item K. Grommet. Brass reinforced hole openings that allows the bungee cord to easily move Item P. 5.5 foot Draw Strings constructed of folded canvas and used to draw the sides of the tent up so as to allow sunlight into the boat.

Item Q. 5.5 foot Draw Strings constructed of folded canvas and used to draw the sides of the tent up so as to allow sunlight into the boat.

FIG. 6 is a top view of the tent, showing:

Item A. Weight pockets where variable amounts of weights, usually plastic bags filled with ¼ pound of sand, are place to help secure the bottom edges of the tent down. The pockets are double stitched to add additional support.

Item B. Forward end Male Common Sense twist fastener ends. The male end of the commonsense twist fasteners are place along the forward reinforced end of the tent every 2". This provides for a secure point to attach a covering for the bow of the boat (which design shall be furnished at a future date) and allows for water to flow aft. Since most boats are moored over the winter bow into the wind, the wind will drive the rain aft helping to shed the water away from the seam and provide a shear to prevent the wind from catching the seam where the two pieces meet and putting stress on the fabric and twist fasteners.

Item C. Flap with common sense twist fasteners for stays. Stays are the cables which fasten from the main deck of the boat and go the height of the mast. These are used to stabilize the mast and keep it from leaning too far one way or the other when the sail is up. The flap is made of 2" squares of reinforced fabric cut on 3 sides with Common sense twist fasteners positioned in the center of the squares. These are designed to allow the stays to go through the tent in such a way as the flap in which the stay goes through can remain unlatched while the others stay secured. This will allow for protection of the deck from the elements, stability of the mast, and the ability to accomplish both while maintaining the tinsel strength of the tent to withstand high winds and driving rains. Additional detail can be seen in Item D. The seam area where the barrel Latch, hook and Grommet system is. This will be seen in more detail in FIG. 3

Item E. Boom ties add another place with which to secure the tent. Ties occur at specific points and are a minimum of 2' long each, depending on the size of ones sail or if one is going to have the tent up while a sail on the boom.

Item F. 2.5 foot flaps that go from the bottom of the fabric to 12 inches from center, one port and one starboard with 110 nylon zippers. The nylon zippers withstand the corrosive effects of both UV and salt air and allow entry to the main hatch and cockpit area of the boat without having to remove the tent or any portion thereof.

Item G. Aft end female common sense twist fastener ends. The female ends of the commonsense twist fasteners are placed along the aft reinforced end of the tent every 2". This provides a secure point to attach a covering for the stern of the boat (which design shall be furnished at a future date) and allows for water to flow aft. Since most boats are moored over the winter bow into the wind, the wind will drive the rain aft helping to shed the water away from the seam and provide a shear to prevent the wind from catching the seam where the two pieces meet and putting stress on the fabric and twist fasteners.

Item Q. 5.5 foot Draw Strings constructed of folded canvas and used to draw the sides of the tent up so as to allow sunlight into the boat.

Item R. Double D Rings used to secure the draw strings. Using double D rings allows the strings to be draw and released easily.

The invention claimed is:

1. A boom tent system for use on sailboats, comprising:

a tent tarp configured to be positioned over a boom of a sailboat and secured to portions of the sailboat with a plurality of securing elements;

wherein the tent tarp comprises port and starboard zippered flaps and a plurality of spaced-apart grommets and weight pouches located along each port and starboard lower side edge of the tent tarp;

wherein the securing elements comprise hooks positioned between grommets for secured anchoring to the sailboat, bungee cords each housed in a flap of the tent tarp for providing adjustable tension of the tent tarp through the grommets, and barrel latches on either side of the hooks for securing against either the hooks or the grommets to allow variable lengths and tensions of the bungee cords and securing in different points along a bungee cord.

* * * * *